US007025067B2

(12) United States Patent
Chatterjee

(10) Patent No.: US 7,025,067 B2
(45) Date of Patent: Apr. 11, 2006

(54) ACTIVATED CHARCOAL FILTER FOR EFFECTIVELY REDUCING P-BENZOSEMIQUINONE FROM THE MAINSTREAM CIGARETTE SMOKE

(75) Inventor: Indu Bhusan Chatterjee, Calcutta (IN)

(73) Assignee: Council of Scientific and Industrial Research, New Delhi (IN)

( * ) Notice: Subject to any disclaimer, the term of this patent is extended or adjusted under 35 U.S.C. 154(b) by 0 days.

(21) Appl. No.: 10/076,041

(22) Filed: Feb. 13, 2002

(65) Prior Publication Data

US 2003/0106562 A1 Jun. 12, 2003

(30) Foreign Application Priority Data

Oct. 4, 2001 (IN) ..... 1025/DEL/2001

(51) Int. Cl.
*A24D 3/04* (2006.01)

(52) U.S. Cl. ..... 131/342; 131/344; 131/341; 131/331; 131/207

(58) Field of Classification Search ..... 131/344, 131/341, 342, 331, 334, 207
See application file for complete search history.

(56) References Cited

U.S. PATENT DOCUMENTS

| | | | | |
|---|---|---|---|---|
| 3,658,069 A | | 4/1972 | Wise et al. | 131/10.7 |
| 4,038,992 A | | 8/1977 | Ogasa et al. | 131/10.7 |
| 4,201,234 A | * | 5/1980 | Neukomm | 131/265 |
| 4,373,539 A | | 2/1983 | Innacelli | 131/209 |
| 5,360,023 A | | 11/1994 | Blakley et al. | 131/331 |
| 5,423,336 A | * | 6/1995 | Mentzel et al. | 131/344 |
| 5,909,736 A | | 6/1999 | Stavridis et al. | 131/331 |
| 6,257,242 B1 | * | 7/2001 | Stavridis | 131/344 |

FOREIGN PATENT DOCUMENTS

WO WO 96/00019 1/1996

OTHER PUBLICATIONS

Slade, Henningfield, Wynder and Hoffman, "*Test Marketed Advance Low TSNA Cigarette with Dalmation Type Activated Charcoal/Acetate Filter*", www.starscientific.com/066745321909/advancefilter.html.
Daniel Givelber, "*Cigarette Law*", www.law.indiana.edu/ilj/v73/no3/givelber.html.
What's New, "*Baumgartner Uses Carbon Efficiently in Filter Design*", www.baumgarnerinc.com/whatsnews.shtml.
Brandy Fisher, "*Filtering New Technology*", Tobacco reporter Feature Story, www.tobaccoreporter.com/backissues/dec2000/dec2000_Featrure2asp.
H. J. Bailey Company, "*Filter Tubes-A key Development in RYO Smoking-and now one with Activate Charcoal in the Filter*", www.ryomagazine.com/October/filters.htm, Oct./Dec. 2000.

* cited by examiner

*Primary Examiner*—Dionne W. Mayes
(74) *Attorney, Agent, or Firm*—Ohlandt, Greeley, Ruggiero & Perle, L.L.P.

(57) ABSTRACT

A filter for tobacco smoke inhaling/generating/producing device, comprising stipulated amounts of specific grain sizes or combination of grain sizes of activated charcoal for effectively reducing from the mainstream smoke the level of p-benzosemiquinone (p-BSQ), a relatively stable highly reactive major harmful oxidant, without significantly affecting the flavor and taste of the smoke while providing comfortable mouthful of smoke and nicotine delivery, so that the charcoal filter cigarettes becomes potentially less hazardous safer cigarettes and may be acceptable to the smokers with marked reduction in health risk; the charcoal filters also effectively reduce the level of nitric oxide and tar from the mainstream smoke.

29 Claims, 4 Drawing Sheets

Drawing of a typical charcoal filter cigarette.

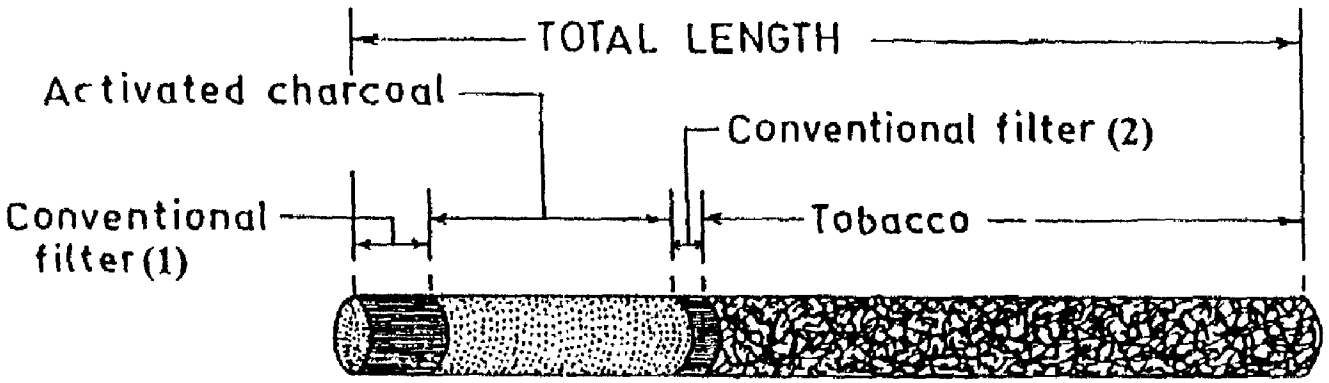
Fig 1. Drawing of a typical charcoal filter cigarette.

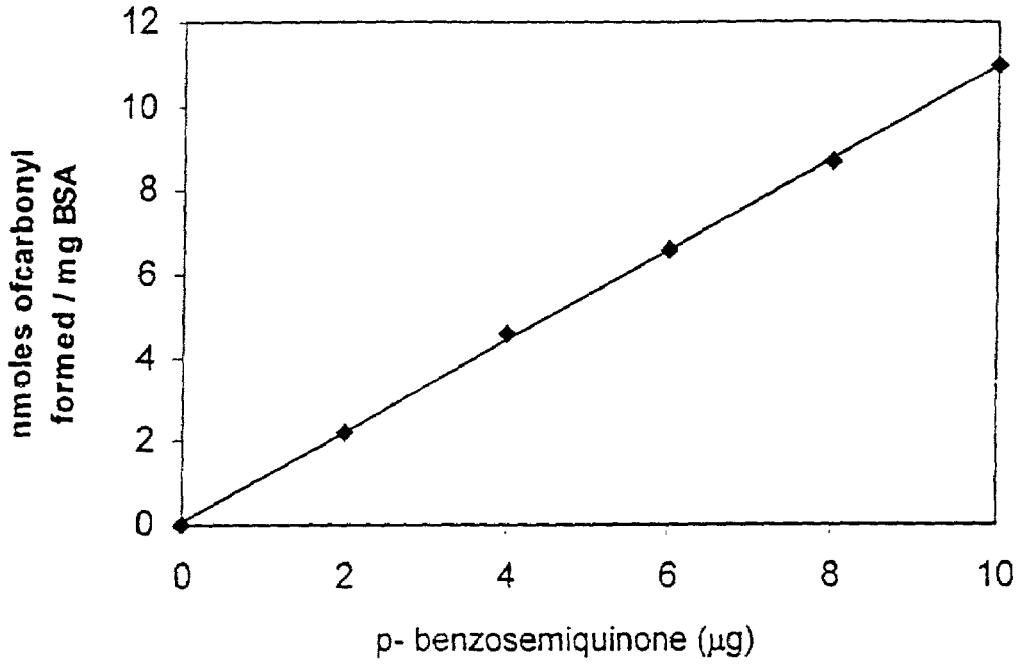
Fig.2 Carbonyl formation in BSA by p-benzosemiquinone

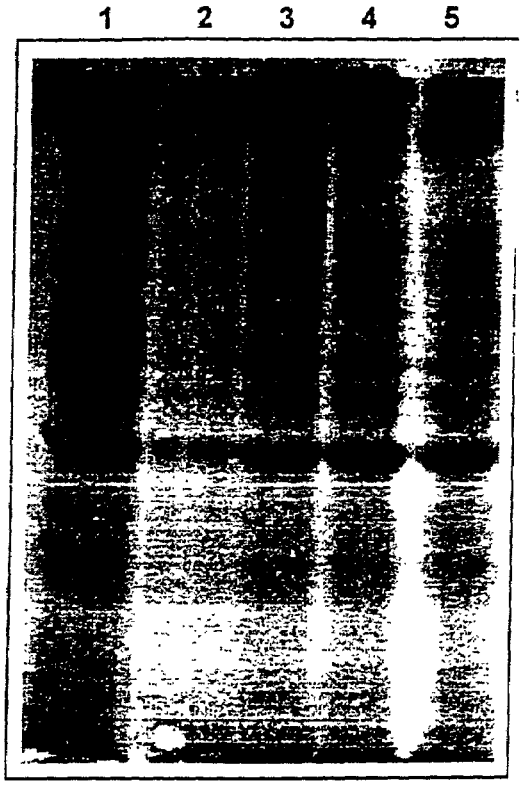
Fig.3. SDS-PAGE showing protective effect of charcoal filters on the cigarette smoke induced oxidative degradation of guinea pig lung microsomal proteins.

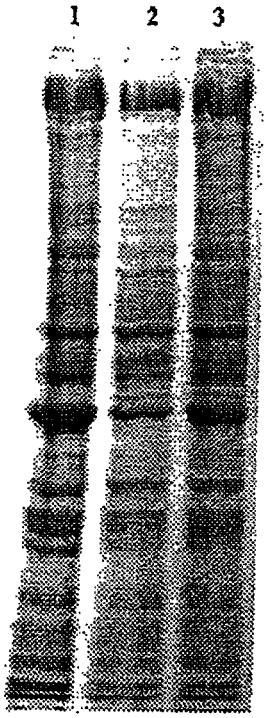
Fig 4. SDS-PAGE of lung microsomal proteins of normal guinea pigs and guinea pigs exposed exposed to smoke from cigarettes with and without charcoal filter.

ACTIVATED CHARCOAL FILTER FOR EFFECTIVELY REDUCING P-BENZOSEMIQUINONE FROM THE MAINSTREAM CIGARETTE SMOKE

FILED OF THE INVENTION

The present invention relates to an activated charcoal based tobacco smoke filter device, for effectively reducing level of p-benzosemiquinone (p-BSQ) a highly reactive major harmful oxidant from the mainstream cigarette smoke while providing comfortable mouthful of smoke and nicotine delivery with considerable reduction in health risk—to the smokers. The said device also reduces other components of the tobacco smoke such as nitric oxide, nicotine etc.

BACKGROUND AND PRIOR ART REFERENCES

Cigarette smoking is the world's single most preventable cause of disease and death. Worldwide, about 36 percent of all adults smoke cigarettes. According to a 1999 World Health Organization estimate, there are 4 million deaths a year from tobacco. Tobacco smoke contains more than 4000 compounds. Among these, nicotine is the habit forming pharmacological agent. Others are toxins, mutagens and carcinogens that cause or enhance various degenerative diseases including cancer of lung and other organs, chronic obstructive pulmonary disease such as bronchitis and emphysema as well as heart disease and stroke. Since approaches to cessation of smoking by public health campaigns and anti-smoking laws passed by local Governments have had limited success, the most practicable approach is the prevention of the hazardous effects caused by cigarette smoke. Modification of the cigarette is in itself a practical approach to reducing the toxic compounds contained in cigarette smoke. One of the approaches was to use cigarette filters. This is what the cigarette manufacturers have been trying to do for the last few decades.

The cigarette companies have introduced cigarettes with filter tips to reduce the harmful compounds in the smoke, apparently to produce safer cigarettes without affecting the flavour and nicotine content of the smoke. There are four main types of filters in use to-day, namely, cellulose acetate, polypropylene, pure cellulose and filters containing granular additives, mainly activated charcoal (1). Cellulose acetate dominates the global filter market with 68 percent. Polypropylene filters follow with 21 percent (almost all of which are in China), charcoal filters comprise 10 percent and cellulose filters comprise less than 1 percent. Since it is difficult in selectively reducing specific compounds, the companies have focused on reducing the tar components, which is thought to contain the majority of harmful compounds. This was the reason of the wide utilization of cellulose acetate filter tips. While this process is effective for reducing a little portion of the tar, it is not at all selective for individual compounds, particularly the gaseous and vapour phase components of cigarette smoke. However, tar is a poor concept as a basis for regulating tobacco. It is known that different brands of cigarettes produce tars with greatly varying concentrations of key toxins. Many people smoke low tar/low nicotine products believing that smoking these products are safer or will reduce their risks of cancer and other diseases. However, in doing so they typically change the way they smoke to get more nicotine. In order to compensate for lower levels of nicotine, many smokers often take bigger, deeper or more frequent puffs or smoke more cigarettes to obtain their needed levels of nicotine. Therefore, their exposure to toxins is not really reduced.

This is why health scientists do not consider 'lights' or 'ultra lights' cigarettes as reliably less hazardous. In fact, till date there is no such thing as a safe cigarette. Obviously, such cigarettes with lower tar and nicotine content many be a distracting illusion of reduced harm and may not give any health benefit. This is particularly because the factors of cigarette smoke, which contribute to the known risks, are still not clearly defined. We consider that reducing the undesirable compounds in smoke is certainly of great importance, but selectively reducing the most undesirable compound is likely to be the most effective way of lowering the risk of smoking.

Activated charcoal filters seem to be better than cellulose acetate filters. These filters remove significant amounts of some toxic and irritant gases and semivolatile organic compounds, which the cellulose filters, do not. However, there is presently no data directly linking the use of commercially available charcoal filters to lowered risk of smoking. It would have been ideal to pinpoint one compound or a group of compounds as the main culprit in cigarette smoke and to use a filter to selectively reduce this. Since the factors in cigarette smoke that contribute to the known risks are not clearly understood, a clear definition of a safer or lower risk cigarettes does not exist. In fact, there is no existing parameter by which toxicity or carcinogenic potential of a particular brand of cigarette can be measured.

Nevertheless, at present the most discussed carcinogens and toxins are the tobacco specific nitrosamines (TSNA) particularly, N-nitrosonornicotine (NNN) and 4-(methylnitrosamino)-1-(3-pyridyl)-1-butanone (NNK), polynuclear aromatic hydrocarbons (PAH) such as benzo(a) pyrene, aldehydes (e.g. acetaldehyde, crotonaldehyde), volatile hydrocarbons (benzene, toluene), aromatic amines, trace materials as well as carbon monoxide, nitric oxide, acrolein and phenol. However, it is yet to be known which of these carcinogens toxins is most harmful and whether removal of all these will reduce the risks of smoking and incidence of cancer. For many years it has been believed that polycyclic aromatic hydrocarbons, particularly benzo(a) pyrene, play a major role in the development of lung cancer.

Nowadays, TSNAS are the focus of a lot of attention. However, just because these compounds can cause cancer or other diseases on their own, they are not necessarily responsible for cancers or other diseases resulting from tobacco smoke. The carcinogens present in tobacco smoke are at such small concentrations that it is highly unlikely that one would cause cancer or other diseases on its own. For example, the concentration of benzo(a) pyrene in the mainstream cigarette smoke is in the range of 10 to 40 ng (2) and the average amount of both NNK and NNN is 200 ng per cigarette (3). Moreover, not to-date there has been any single compound identified as more responsible than others for the risks associated with smoking. As indicated before, it would have been ideal to pinpoint the most hazardous compound in cigarette smoke and to eliminate it by the use of filters.

The applicants have reported before (4) that the aqueous extract of cigarette smoke contains some stable oxidant, which causes extensive oxidative damage of proteins. Very recently, the applicants have isolated the oxidant from cigarette smoke/tar solution and identified it as a major potentially hazardous compound, which almost quantitatively accounts for the oxidative damage of proteins caused by cigarette smoke solution. The chemical structure of the oxidant has been established to be p-benzosemiquinone (p-BSQ) as evidenced by elemental analysis, mass spectrum, UV, IR, NMR and ESR spectra as well as by chemical properties (5). p-BSQ is a relatively stable free radical, apparently because the unpaired electron is delocalised over an aromatic framework containing heteroatoms leading to different mesomeric forms, namely, anionic, neutral and cationic forms. The half-life of p-BSQ, as determined by its oxidant activity, is 48 hours in solid state at the room temperature and about 1.5 hours in aqueous solution at pH 7.4. We have examined 12 different brands of cigarettes including Indian, American, British, Russian and Japanese cigarettes. The content of p-BSQ in the mainstream smoke of these different brands varies from 104 μg to 200 μg depending on the brand of cigarette. Thus its concentration in the smoke is approximately 5000 to 11,000 times that of benzo(a) pyrene and 520 to 1000 times that of both NNK and NNN. Unlike PAH and TSNA, p-BSQ is a highly reactive strong oxidant which reacts directly with proteins. Besides being responsible for protein oxidation, pBSQ is also responsible for the oxidative damage of DNA. Since DNA oxidation is implicated with mutation and cancer, p-BSQ may be a major factor for the cause of cancer by cigarette smoke. Nagata et. al. have shown that semiquinone damages DNA(6). Pryor has shown that semiquinone free radicals are critically involved in causing DNA damage of a type that is not easily repaired and therefore may lead to mutation and cancer (7). The applicants have considered that toxicity of a particular brand of cigarette can be determined by measuring the level of p-BSQ in the mainstream smoke. Lower the level of p-BSQ; lesser is the toxicity.

Earlier observations of Pryor and his associates (8) suggested that the principal relatively stable radical in cigarette tar might be quinone/hydroquinone/semiquinone complex which was an active redox system and that this redox system was capable of reducing molecular oxygen to produce superoxide, leading to hydrogen peroxide and hydroxyl radicals, which may eventually lead to oxidative damage of biological macromolecules. Since cigarette tar was an incredibly complex mixture and since the tar radicals were not isolated and unambiguously identified, the conclusion of Pryor and his associates (8) concerning the chemistry or biochemistry of the tar radicals was regarded as tentative. The authors thought that the principal radical in tar was actually not a monoradical and probably not a single species. However, as mentioned before, we have observed that the major stable hazardous oxidant in cigarette smoke is a single species namely, p-BSQ. The oxidative damage of proteins produced by p-BSQ is not inhibited by SOD or catalase, affirming that the oxidative damage is not mediated by secondarily produced superoxide and hydrogen peroxide. We have further observed that p-BSQ oxidized protein in the nitrogen atmosphere in the absence of molecular oxygen (4), indicating that there is a direct interaction of p-BSQ and biological macromolecules.

The aforesaid results would indicate that p-BSQ is a major highly reactive harmful oxidant occurring in high concentrations in cigarette smoke, and it is possibly responsible for the oxidative damage of proteins and DNA leading to degenerative diseases and cancer. It would thus appear that on the one hand p-BSQ content in the smoke might be a parameter of toxicity of a particular brand of cigarette and on the other hand elimination of p-BSQ from the mainstream smoke will produce potentially less hazardous safer cigarettes. We have observed that cellulose acetate filter is ineffective in absorbing p-BSQ, but activated charcoal filters adsorbs it. Too much of charcoal in the filter not only eliminates p-BSQ but also drastically reduces the mouthful of smoke, nicotine content as well as the flavor and taste of the smoke. On the contrast, too little charcoal is ineffective in significant reduction of p-BSQ. In fact, elimination of p-BSQ from the smoke depends on the amount of particular grain size or grain sizes or combination of grain sizes of activated charcoal used. So, we have devised cigarette filters using stipulated amounts of specific grain sizes and also combination of grain sizes of activated charcoal to find out optimum filtering devices for effective reduction of p-BSQ from the mainstream smoke. Since activated charcoal is known to adsorb significant amounts of many of the toxic gas and vapor phase components of cigarette smoke, the said activated charcoal filters are expected not only to remove p-BSQ, which is conceived to pose the greatest health risk, but also many other toxic components thereby producing potentially less hazardous cigarettes.

Use of activated charcoal filter is not new. The most prominent forms of charcoal filters are cavity and dual filters made with carbon granules. Cavity filters are manufactured by placing carbon granules in a void space between two segments of cellulose acetate filter tow. Dual filters are produced by sprinkling carbon granules in cellulose acetate filter tow or cellulose or paper mesh. There are quite a number of reports and patents describing charcoal filtered cigarettes. In most cases, the cavity charcoal filters are comprised of activated charcoal mixed with other granular materials including proteins, silica gel, zeolite, alumina, and milled wheat or starch granules. In the dual charcoal filters, small amounts of activated charcoal granules are scatteredly embedded in cellulose acetate filter tow. Since charcoal filters can remove significant amounts of some toxic and irritant gases and vapors including hydrogen cyanide, acrolein and benzene from the gas/vapor phase of the smoke, many researchers believe that reducing exposure to toxic gases is likely to have some benefit to the consumer.

It should be mentioned that none of said cavity filters or dual charcoal filters provides data regarding the amount of specific grain sizes or combination of grain sizes of activated charcoal used in relation to the length of the cigarette selected and the level of p-BSQ in the mainstream smoke. The concept that the level of p-BSQ in the mainstream cigarette smoke may produce the greatest health risk was not known before. As stated earlier, in our recent investigation (5) we have indicated that p-BSQ is a major highly reactive harmful oxidant occurring in high concentrations in the smoke. We have observed that only those charcoal filters that contain stipulated amounts of specific grain sizes or combination of grain sizes of activated charcoal in relation to the length of the cigarette selected are effective in markedly reducing the level of p-BSQ from the mainstream smoke. Activated charcoal mixed with other granular materials or activated charcoal sprinkled in cellulose acetate filter tow is inefficient in significantly reducing the level of p-BSQ from the mainstream smoke.

In anticipation of a health crisis to be precipitated by the Smoking and Health Report of the US Surgeon General's Committee, Philip Morris in early sixties developed a charcoal filter named Saratoga. However, at that time, the relationship between the amount of specific grain sizes of activated charcoal and the level of p-BSQ in the smoke was not known. Moreover, the product as test marketed did not have good taste and was consequently abandoned (9).

U.S. Pat. No. 4,038,992 (10) refers to a granular composition for use in tobacco filters wherein the granules are a blend of 40 to 80% protein granules, prepared either from milk whey protein or egg white protein and 20 to 60% active charcoal granules having a grain size of 10 to 50 mesh, occasionally mixed with excipients including cellulose, starch, sugars, alumina, zeolite and silica gel. The objective was to remove nonspecifically deleterious compounds from tobacco smoke with particular reference to benzopyrene, phenol and tar. No mention was made about the proportion of the different mesh sizes of active charcoal used. In our experience, activated charcoal having grain sizes below BS 44 and particularly mixed with said proteins granules or other granular materials is not efficient in reducing p-BSQ from the mainstream smoke.

U.S. Pat. No. 5,909,736 (11) describes a filter for filtering tobacco smoke comprising activated charcoal impregnated with a biological substance selected from the group consisting of hemoglobin, lysates of erythrocytes and combinations thereof. No mention was made about the grain sizes and the amount of the activated charcoal used in relation to the length of the cigarette. Moreover we have observed that activated charcoal impregnated with hemoglobin solution or lysates of erythrocytes is ineffective for removing p-BSQ from the mainstream smoke.

U.S. Pat. No. 4,373,539 (12) describes a smoking device comprising a means to hold a coiled helical tube filled with compressed carbon or activated charcoal having an inside diameter of approximately one-eight inch (≈3.125 mm) and a length of approximately one and one-quarter inches (≈31.25 mm) which when uncoiled is approximately six inches (≈150 mm) long. The objective of the invention was to eliminate the harmful tar. No data was given about either the grain sizes of the activated charcoal used or the nicotine delivery in the mainstream smoke. In addition, no biological experimental data was provided to indicate that the smoke coming out of the said filter was less toxic. It is obvious that smoke passing through activated charcoal of such longer filtration route would have minimum nicotine level in the smoke. Since value of a filter depends on the extent that it can selectively remove tar constituents without removing nicotine, the said coiled helical tube-filtering device containing activated charcoal has little practical application.

WO Patent No. 9600019 (13) refers to a filter containing activated charcoal enriched with a biological substance containing Fe, Cu and/or complexes with a porphyrin ring and Fe bound in protein molecules. No data was provided about either the grain sizes of charcoal or the amount of charcoal used in relation to the length of the cigarette. As stated before, we have observed that activated charcoal enriched with the said biological substances is inefficient in reducing p-BSQ from the mainstream cigarette smoke.

U.S. Pat. No. 5,360,023 (14) describes a cigarette filter in which the filter element preferably includes two or more filter segments of which one of the segments includes a carbonaceous material e.g. an activated carbon materials or an activated charcoal material in a powdered or fine grain from. The carbonaceous material is preferably incorporated into the filter segment as a component of a paper, typically as a gathered paper web. The filter segment including the carbonaceous material is constructed so as to have a number of longitudinally extending channels or air passageways extending through that filter segment. The channels or air passageways are of a cross-sectional area such that particular phase components of mainstream smoke passing through the filter segment are not filtered by or do not interact to a significant degree with the carbonaceous material. In this case also the said filter segment containing the carbonaceous material neither describe the grain sizes of charcoal or the amount of charcoal used in relation to the length of the cigarette. Moreover, since the air channels were used for preventing significant interaction of the mainstream smoke with the carbonaceous material, the possibility of effective reduction of the level of p-BSQ from the smoke is not expected.

U.S. Pat. No. 3,658,069 (15) refers to a filter element containing about 50 mg of activated carbon. However, neither the grain sizes nor the amount of charcoal used in relation to the level of p-BSQ in the smoke has been described.

Recently a patent-pending Advance cigarette, made by Virginia-Star scientific Inc., contain specially cured tobacco with reduced level of nitrosamines and activated-charcoal filter is being marketed (16). The activated charcoal has been used for removing some toxic gases in cigarette smoke. However, data on the amount of specific grain sizes of activated charcoal in relation to the length of the cigarette and the level of p-BSQ in the mainstream smoke has not been given. Moreover, no scientific or biological experimental data has been provided.

A filtered tube named "Gizes's Silvertip Charbon activated charcoal filter tube" has been produced by RYO (17). These silvertip tubes are costly and manufactured for repeated use. However, we have observed that the charcoal filters, when used more than once become ineffective in reducing p-BSQ level from the mainstream smoke. Moreover, data on the amount of specific grain sizes of charcoal used in relation to the length of the cigarette selected is not given.

A cavity filter, named CAVIFLEX, has been developed by Baumgartner, where low amounts of activated carbon, occasionally mixed with certain inert material, e.g. milled wheat, are used to fill up the cavity (18). However the amount of specific grain sizes of charcoal used in relation to the length of the cigarette and the level of p-BSQ in the mainstream smoke are not known.

Among the commercial charcoal filter cigarettes available in the market, about less than 1 percent of American cigarettes and 2 percent of Russian cigarettes use charcoal filters. However, charcoal is most popular in Japan. Out of the total Japanese cigarette market, about 95 percent have charcoal filters. Charcoal is also popular in South Korea, where the most widely used charcoal filters (about 90 percent) contain activated carbon blended with zeolite. In Hungary and Venezuela cigarette market, 90–95 percent have charcoal filters. In most cases, the charcoal filter contains small amount of activated charcoal granules distributed in some porous material or embedded within cellulose acetate filter tow. Charcoal filters in general reduce gaseous toxins in the smoke. But no evidence exists that the already available commercial charcoal filter cigarettes are significantly less dangerous for the users. We have examined one brand of Russian charcoal filter cigarette and one brand of mild Japanese charcoal filter cigarette containing low tar and low nicotine. The Russian cigarette had about 16-mg tar, 590-μg nicotine and 128 μg of p-BSQ in the mainstream smoke. The Japanese cigarette had about 12-mg tar, 500-μg nicotine and 104-μg p-BSQ in the smoke. The Russian cigarette contained about 10 mg of charcoal and the Japanese cigarette about 30 mg of charcoal scatterly embedded in cellulose acetate filter tow. The applicants observed that the p-BSQ content of the smoke from both the cigarettes remained unaltered irrespective of whether the charcoal filter was present or replaced by similar length of conventional cellulose acetate filter. This would indicate that the charcoal filters incorporated in both the Russian and the Japanese cigarettes were ineffective in reducing p-BSQ content of the mainstream smoke. As would be expected, BSA oxidation by the aqueous extract of CS from both the Russian cigarette (7.5±0.2 nmoles of carbonyl/mg BSA) and mild Japanese cigarette (6.2±0.2 nmoles of carbonyl/mg BSA) remained unaltered irrespective of whether the charcoal filters were present or replaced by similar length of conventional cellulose acetate filter.

Although charcoal filters are commercially available, those are not effective in reducing the p-BSQ of the smoke. Nevertheless, this invention may be considered a re-evaluation and improvement of the existing state of art. Since activated charcoal not only adsorbs p-BSQ but also some tar and nicotine, the said charcoal filter cigarettes may be categorized as relatively low tar, low nicotine mild cigarettes. Apprehending that there might be some smokers who would not like mild cigarettes with low nicotine delivery, the tobacco of some of the said charcoal filter cigarettes will be fortified with nicotine to produce regular cigarettes with comparable nicotine content without any increase in the p-BSQ level of the smoke.

OBJECT OF THE INVENTION

The object of the present invention is to provide special activated charcoal filters mainly to reduce from the mainstream smoke p-benzosemiquinone (p-BSQ), a highly reactive major harmful oxidant, which is singly responsible for the oxidative damage of proteins and probably also DNA, thus conceived to pose the greatest health risk.

Another object of the invention is to use stipulated amounts of specific grain sizes or mixture of specific grain sizes of activated charcoal to produce potentially less hazardous cigarettes, without significantly affecting the taste and flavour while providing comfortable mouthful of smoke and nicotine delivery.

Still another object of the invention is that the said charcoal filter cigarettes should be acceptable to the smokers with marked reduction in health risk.

Another object of the invention is to provide a filter device useful in reducing p-BSQ level, which can be used in any type of smoking device.

SUMMARY OF THE INVENTION

Accordingly, the present invention provides an activated charcoal based tobacco smoke filter device, for effectively reducing level of p-benzosemiquinone (p-BSQ) a highly reactive major harmful oxidant from the mainstream cigarette smoke while providing comfortable mouthful of smoke and nicotine delivery with considerable reduction in health risk—to the smokers. The said device also reduces other components of the tobacco smoke such as nitric oxide, nicotine etc.

In accordance to the present invention provides a cigarette smoke filter comprising stipulated amounts of specific grain sizes or combination of grain sizes of activated charcoal for effectively reducing p-benzosemiquinone (p-BSQ) from the mainstream smoke without significantly affecting the taste and flavor while providing comfortable mouthful of smoke and nicotine delivery. p-BSQ is a relatively stable free radical and a highly reactive major harmful oxidant present in the cigarette smoke, which is mainly responsible for the oxidative damage of proteins as well as DNA. The different grain sizes or combination of different grain sizes of activated charcoal have been selected from BS (British standard mesh) 25/44, 44/52, 52/60, 60/72, 72/85 and 85/100. The level of p-BSQ in the smoke from different charcoal filters cigarettes is reduced 55 to 85 percent, which is accompanied by inhibition of BSA oxidation to the extent of 55 to 82 percent. The charcoal filters also effectively reduce nitric oxide 44 to 68 percent and tar 10 to 50 percent from the mainstream smoke. Nicotine delivery, which is reduced to some extent by the charcoal filters, is replenished by fortification of the tobacco with nicotine without any increase in the p-BSQ level of the smoke, apparently because nicotine is not a precursor of p-BSQ.

DETAILED DESCRIPTION OF THE INVENTION

In accordance, the present invention provides a filter for tobacco smoke inhaling/generating/producing device, the said filter comprising three sections placed longitudinally one after another wherein, the first section comprising cellulose acetate fibre acting as a mouth piece, the second section comprising activated charcoal selected from group consisting of charcoal particles having grain size ranging between 25 mesh and 100 mesh for effectively reducing p-benzosemiquinone, a highly reactive major harmful oxidant from the mainstream of cigarette smoke and the third section comprising cellulose acetate fibre located closer to the tobacco portion of the cigarette also acting as a barrier between the activated charcoal and tobacco In embodiment of the invention, wherein length of the first section is in the range of 10 to 14 mm, length of the second section 4.5 mm to 35 mm which is dependent on the grain size and/or amount of charcoal used and length of the third section is in the range of 2to 3 mm.

In another embodiment of the invention, wherein length of the second section is in the range of 4.5 mm to 35 mm consisting of one or more activated charcoal particles.

In another embodiment of the invention, wherein all the three sections are linearly joined together in succession using a thin wall tube made of light material selected from the group consisting of thin wall plastic tube, paper, plastic wrapped paper and aluminum foil.

Still another embodiment of the invention, wherein the activated charcoal filter consisting of charcoal granules which, are placed in a void space between the sections of cellulose acetate filters namely the mouthpiece and the barrier.

Still another embodiment of the invention, wherein the amount of charcoal used is in the range between 0.1 g and 0.6 g Yet another embodiment of the invention, each charcoal bed of length 5.0±0.5 mm is packed with 0.1 g of charcoal granules.

Yet another embodiment of the invention, wherein the activated charcoal used is selected from group consisting of charcoal particles with grain size ranging between 25 mesh and 150 mesh, preferably 100 mesh.

Yet another embodiment of the invention, wherein the activated charcoal used is selected from the group consisting of BS 25/44, BS 44/52, BS 52/60, BS 60/72, 72/85 and 85/100 for effectively reducing p-BSQ from the mainstream smoke.

Yet another embodiment of the invention, the amount of BS 44/52-grain size charcoal used is in the range of 0.2 to 0.3 g.

Yet another embodiment of the invention, the amount of BS 44-grain size charcoal used is up to 0.4 g.

Yet another embodiment of the invention, the amount of BS 52/60-grain size charcoal used is in the range of 0.2 to 0.3 g.

Yet another embodiment of the invention, the amount of BS 60/72-grain size charcoal used is in the range of 0.15 to 0.20 g.

Yet another embodiment of the invention, the amount of BS 72/85-grain size charcoal used is in the range of 0.10 to 0.15 g.

Yet another embodiment of the invention, the amount of activated charcoal used consists of 0.4 g of BS 44 and 0.2 g of. BS 52.

Yet another embodiment of the invention, wherein the activated charcoal mixture used consists of 0.2 g of BS 44/52 and 0.1 g of BS 52/60.

Yet another embodiment of the invention, wherein the activated charcoal mixture used consists of 0.2 g of BS 44/52 and 0.1 g of BS 60/72.

Yet another embodiment of the invention, wherein the activated charcoal mixture used consists of 0.1 g of BS 44/52 and 0.1 g of BS 72/85.

Yet another embodiment of the invention, wherein the activated charcoal mixture used consists of 0.2 g of BS 44/52 and 0.1 g of BS 72/85.

Yet another embodiment of the invention, wherein the activated charcoal mixture used consists of 0.15 g of BS 44/52 and 0.1 g of BS 72/85.

Yet another embodiment of the invention, wherein the activated charcoal mixture used consists of 0.1 g of BS 52/60 and 0.1 g of BS 60/72.

Yet another embodiment of the invention, wherein the activated charcoal mixture used consists of 0.1 g of BS 52/60 and 0.1 g of BS 72/85.

Yet another embodiment of the invention, wherein the activated charcoal mixture used consists of 0.1 g of BS 60/72 and 0.1 g of BS 72/85.

Yet another embodiment of the invention, wherein the activated charcoal mixture used consists of 0.1 g of 52/60 and 0.05 g of BS 72/85.

Yet another embodiment of the invention, wherein the activated charcoal mixture used consists of 0.1 g of BS 60/72 and 0.05 g of BS 72/85.

Yet another embodiment of the invention, wherein said filter inhibits p-benzosemiquinone (p-BSQ )of the mainstream smoke up to 85 percent.

Yet another embodiment of the invention, wherein the said filter inhibits the protein oxidation, as evidenced by carbonyl formation in BSA by the mainstream cigarette smoke solution up to 89 percent.

Yet another embodiment of the invention, wherein said filter reduces nitric oxide (NO) of the mainstream smoke up to 68 percent.

Yet another embodiment of the invention, wherein the nicotine delivery in the mainstream smoke is reduced from 935 μg to 350–400 μg per cigarette.

Yet another embodiment of the invention, wherein the mainstream smoke solution is incapable of producing significant oxidative damage to guinea pig lung microsomal proteins in vitro One more embodiment of the invention related to use of nicotine fortified tobacco, which results in increase in delivery of nicotine without increasing the level of p-BSQ.

Another embodiment of the invention, wherein tobacco fortified with 2 to 4 mg of nicotine increases the nicotine delivery without increasing the level of p-BSQ.

Still another embodiment of the invention, wherein tobacco fortified with 2 to 4 mg of nicotine increase the nicotine delivery in the main stream smoke from 350–400 μg to 575–700 μg without increasing the level of p-BSQ.

Still another embodiment of the invention, wherein nicotine fortified tobacco with 2 to 4 mg of nicotine, delivers nicotine up to 90% without increasing the level of p-BSQ.

Still another embodiment of the invention, wherein said tobacco inhaling filter device may be used in cigarettes, cigars, pipes, bedi, cigar holders and any other conventional smoking devices.

One more embodiment of the invention provides a smoking device for use in a cigarette, said cigarette comprising a tobacco unit and a filter unit, said tobacco unit filled with tobacco particles and said filter unit comprising three sections placed longitudinally one after another wherein, the first section comprising cellulose acetate fibre acting as a mouth piece, the second section comprising activated charcoal and the third section comprising cellulose acetate fibre located abutting the tobacco portion of the cigarette this acting as a barrier between the activated charcoal and tobacco.

Yet another embodiment of the invention, wherein the smoke from activated charcoal filter of cigarettes, cigars, pipes, cigar holders or any other conventional smoking devices exhaled by smokers containing markedly low level of p-BSQ is potentially less hazardous to passive smokers.

Yet another embodiment of the invention, wherein the mainstream cigarette smoke containing very low level of p-BSQ is incapable of producing significant oxidative damage to the lung microsomal proteins of guinea pigs in vivo when the animals are exposed to smoke emitted from the said charcoal—filtered cigarettes in contrast to marked damage of the lung tissue when the animal are exposed to smoke from cigarettes without having the said charcoal filter.

The invention is described with reference to the examples, which are provided by way of illustration only, and these examples should not be construed to limit the scope of the present invention.

BRIEF DESCRIPTION OF THE ACCOMPANYING DRAWINGS

FIG. 1 represents a typical charcoal filter cigarette, wherein (1) Conventional cellulose acetate fibre filter, acting as the mouthpiece, the length of which may vary according to convenience, e.g. 10–15 mm. (2) Conventional cellulose acetate fibre filter, acting as a barrier between the charcoal bed and the tobacco portion to prevent infiltration of charcoal into tobacco, the length of which may be 2–4 mm. The length of the activated charcoal bed can vary depending on the amount of charcoal used, e.g. 4.5–5.5 mm per 100 mg, 9–11 mm % 200 mg and 13–16 mm per 300 mg charcoal etc., FIG. 2 represents a graphical representation of carbonyl formation in BSA by p-BSQ.

FIG. 3 represents SDS-PAGE showing protective effect of charcoal filters on the cigratte smoke induced oxidative degradation of guinea pig lung microsomal proteins, wherein, lane 1, microsomes incubated in the absence of cigarette smoke solution; lane 2, microsomes incubated in the presence of solution of smoke from cigarettes without any charcoal filter; lanes 3–5, microsomes incubated with smoke solution form cigarettes having charcoal filters; lane 3, BS 52/60, 0.3 g; lane 4, a mixture of BS 44/52, 0.2 g and BS 72/85, 0.1 g, lane 5, a mixture of BS 60/72, 0.1 g and BS72/85, 0.1 g; In each case, the microsomal suspension (1 mg protein) was incubated with 50 μl smoke solution in a final volume of 20 μl of 50 mM potassium phosphate buffer, pH 7.4 for 2 hours at 37° C. After incubation, 40 μl of the incubation mixture was subjected to 10% SDS-PAGE. The gel was stained with Coomassie Brilliant Blue R-250

FIG. 4 represents SDS-PAGE of lung microsomal proteins of normal guinea pigs and guinea pigs exposed to smoke from cigarettes with and without charcoal filter, wherein, Lane 1- Lung microsomes of normal guinea pigs Lane 2- Lung microsomes of guinea pigs exposed to smoke from cigarettes without charcoal filter Lane 3- Lung microsomes of guinea exposed to smoke from cigarettes equipped with activated charcoal filter containing a mixture of 0.1 g of BS 52/60 and 0.1 g of BS 60/72

BRIEF DESCRIPTION OF THE TABLES APPEARING AT THE END OF THE DESCRIPTION IS GIVEN BELOW

Table 1. p-Benzosemiquinone (p-BSQ), BSA oxidation, nicotine delivery and tar contents in the smoke solution from an Indian commercial cigarette with stipulated amounts of different grain sizes of activated charcoal.

Table 2. Effect of fortification of tobacco of the charcoal filter cigarettes with nicotine on the p-BSQ, tar and nicotine delivery in the smoke solution of the smoke from an Indian commercial cigarette Table 3. Effects of charcoal filters on the nitric oxide level in the smoke solution from an Indian commercial cigarette.

Table 4. Inactivation of the major harmful cs-oxidant and nicotine delivery in cigarette smoke using activated charcoal filter

Methodology

Construction of Activated Charcoal Filter

The activated charcoal filter was constructed by placing stipulated amounts of different grain sizes or mixture of grain sizes of activated charcoal in a thin plastic tube, the inside diameter of which was same as the outside diameter of the tobacco portion of the cigarette or the conventional cellulose acetate filter. The plastic tube could be replaced by tubes manufactured of light grade materials, namely hard paper tube, plastic wrapped paper tube or tube made with aluminium foil. At the one end of the tube containing the charcoal was inserted the conventional cellulose acetate filter (approximately 10–14 mm) which constitutes the mouthpiece and at the other end was inserted the tobacco portion of the cigarette (approximately 63 mm). A thin section of cellulose acetate filter (approximately 3 mm) was placed in the cavity in between the tobacco portion and charcoal bed as depicted in the drawing (FIG. 1). Essentially, the charcoal filter is a cavity filter where the activated charcoal granules are placed in a void space between two segments of cellulose acetate filters. As mentioned above, one portion of the cellulose acetate filter (≈10–14 mm) is the mouthpiece and other portion (≈3 mm) constitutes a barrier between the charcoal bed and the tobacco portion (FIG. 1). The portions, namely, the cellulose acetate mouth piece, the charcoal filter, the thin cellulose acetate filter placed in between the charcoal and the tobacco portion and the tobacco portion all are constructed into one single unit (FIG. 1). The cellulose acetate filter does not necessarily improve the filtration of p-BSQ of the smoke. However, its use in cooperation with the charcoal filter adds to the convenience of using it as a mouthpiece for suction. The thin section of the cellulose acetate filter placed in between the charcoal and the tobacco portion was used to prevent any infiltration of charcoal granules into the tobacco of the cigarette. The length of the charcoal packed in the filter corresponded approximately to the weight of the charcoal used. The weight to length proportion was usually 100 mg charcoal corresponding to 5 mm, 200 mg charcoal, 20 mm and so on. The total length of a charcoal filter cigarette using 300 mg of charcoal is 91 mm [10 mm cellulose acetate filter as a mouthpiece, 15 mm charcoal bed, 3 mm cellulose acetate as a partition between charcoal bed and tobacco portion and 63 mm tobacco portion]. The length of the cellulose acetate may be varied, because it is practically ineffective in reducing p-BSQ of the smoke. The grain size of charcoal used has been expressed in the British Standard (BS) mesh. The size BS 25/44 means particles passing through mesh 25 but retained on mesh 44. Similarly, BS 44/25 means particles passing through mesh 44 but retained on mesh 52. All other grain sizes used in this invention, namely BS 52/60, 60/72 and 72/85 are explained in the same way. The length of the charcoal filter can be varied up to 35 mm, length of conventional filter i.e. cellulose acetate filter can be up to 13 mm for cigarette tobacco length of about 63 mm. (Table 4)

Measurement of p-Benzosemiquinone (p-BSQ)

p-BSQ was quantitatively measured by HPLC as described before (5). Five to ten micro liters of the filtered smoke solution was diluted with mobile phase and 20 μl of this diluted solution was injected to the HPLC column with the UV detector set at 294 nm. The parameters used are as follows.

| | |
|---|---|
| Instrument | Simadzu 10A |
| Column | Silica column (Lichrospher ® Si60, Merck) |
| Mobile phase | Methylene chloride:methanol (90:10, v/v) |
| Flow rate | 0.5 ml/min |
| Pressure | 29 Kgf/cm$^2$ |
| Retention time | 8.808 |

The amount of p-BSQ present in the smoke solution was calculated from the peak area, taking 100 ng of p-BSQ corresponding to an arbitrary area of 1,90,000 obtained from a standard curve.

The efficacy of activated charcoal filters was also determined by measuring the comparative yields of p-BSQ. p-BSQ was isolated from cigarette smoke solution by fractional solvent extraction followed by band TLC as described before (5). After proper dilution of the TLC band extract with the mobile phase, 20 μl of the diluted solution was injected to the HPLC column. p-BSQ was detected at 288 nm, which is the λmax of p-BSQ in the mobile phase used. The parameters used are as follows.

| | |
|---|---|
| Instrument | Simadzu 10A |
| Column | Lichrospher ® 100 RP-18 endcapped (5 μm), Merck |
| Mobile phase | Water:methanol (95:5, v/v) |
| Flow rate | 0.5 ml/mm |
| Pressure | 38 Kgf/cm$^2$ |
| Retention time | 7.242 min |

Measurement of Oxidative Damage of Proteins

Protein oxidation as evidenced by carbonyl formation was measured by reaction with 2,4-dinitrophenyl hydrazine similar to that done before in our laboratory (4). When BSA was used, the values were expressed as nmoles of carbonyl formed per mg BSA. The incubation system contained 1 mg BSA and 50 μl of smoke solution obtained from cigarettes with or without charcoal filter in a final volume of 200 μl of 50 mM potassium phosphate buffer, pH 7.4. After incubation for 1 hr. at $37^{0C}$, the protein was precipitated with 200 μl of trichloroacetic acid solution and the rest of the procedure followed as before (4). Oxidative damage of proteins was also measured by sodium dodecyl sulfate polyacrylamide gel electrophoresis (SDS-PAGE) of guinea lung microsomal proteins as described before (4).

Preparation of Microsomes

Guinea pig lung microsomes, washed free of ascorbic acid, were prepared as described before (4).

Sodium Dodecyl Sulfate Polyacrylamide Gel Electrophoresis (SDS-PAGE)

SDS-PAGE of microsomal proteins was performed by the procedures similar to that described before (4).

Measurement of Nicotine

Smoke from a lit cigarette was allowed to dissolve in 2 ml of 50 mM potassium phosphate buffer, pH 7.4 and filtered through 0.45 μm Millipore filter as described before (5). One milliliter of the yellow coloured filtrate was extracted with one milliliter of methylene chloride by vigorous vortexing to extract the nicotine in the methylene chloride layer. Five hundred microliter of the methylene chloride layer containing the nicotine was then vortexed with 500 μl of 50 mM HCl solution and the nicotine of the HCl solution was estimated by HPLC analysis at 254 nm. Five to 10 μl of the nicotine solution was diluted to 200 μl with the mobile phase and 20 μl of this diluted solution was injected to the HPLC column. A standard solution of nicotine was prepared in a similar way and analyzed. The parameters used are:

| | |
|---|---|
| Instrument | Shimadzu 10A |
| Column | Lichrospher ® 100 RP-18 endcapped (5 μm), Merck |
| Mobile phase | 50 mM $KH_2PO_4$ solution: accetonitrile:methanol; (78:17:5, v/v) containing 1 mM sodium hepatane sulfonate, pH 5.0 |
| Flow rate | 0.3 ml/min |
| Pressure | 24 Kgf/cm$^2$ |
| Temperature | 25° C. |
| Retention time | 4.185 min. |

The minimum amount of nicotine that could be detected by the HPLC analysis under the conditions was 10 ng.

Measurement of Tar

Tar was collected by placing a Millipore filter unit between the lit cigarette with or without charcoal filter and the tube connected to a vacuum pump (LKB, Sweden) using a suction of 30 cm water. The Millipore filter (0.22 μm) was changed every two minutes to avoid clogging of the filter. For each cigarette, 4 filters were used. After complete burning of the tobacco, the filters were dried in a vacuum desiccator and weighed. The difference in weight of the filters before and after collecting the particulate portion was the weight of the tar.

Measurement of Nitric Oxide in Cigarette Smoke Solution

Ten milliliter of air saturated 50-mM potassium phosphate buffer, pH 7.4 was taken in a 50 ml boiling tube with a side arm and a stopper with a hole. An Indian commercial cigarette was mounted in a tube that penetrated the hole in the stopper and dipped down in the buffer solution. The side arm was connected to a water pump. The cigarette was lit and the smoke from the whole cigarette was bubbled through the buffer solution by applying a suction of 4 cm water. A portion of the cigarette smoke solution thus produced was filtered through a 0.45 μm Millipore filter and extracted thrice with equal volume of methylene chloride. The concentration of potassium nitrite in the aqueous layer was measured after proper dilution by diazotization using Griess regent. A standard solution of $NaNO_2$ was run side by side.

Exposure of Guinea Pigs to Cigarette Smoke

The exposure of the animals to cigarette smoke was done according to a procedure standardized in our laboratory (19). The guinea pigs were grouped as follows:

Group 1: Control guinea pigs

Group 2: Guinea pigs subjected to smoke from cigarettes without charcoal filter

Group 3: Guinea pigs subjected to smoke from cigarettes equipped with activated charcoal filter containing a mixture of 0.1 g of BS 52/60 and 0.1 g of BS 60/72.

The animals were exposed to cigarette smoke from five cigarettes/animal/day for seven days following the procedure published before (19). The animals were fasted overnight, sacrificed on the eighth day, tissue excised, microsomes prepared and subsequently subjected to SDS-PAGE as described earlier (19).

RESULTS

Effects of Charcoal Filters on the p-BSQ, Tar and Nicotine Contents of the Mainstream Smoke as well as Inhibition of Protein Oxidation Using charcoal filter comprising stipulated amounts of different grain sizes or mixture of grain sizes of activated charcoal, the p-BSQ contents of the mainstream smoke are markedly reduced (Table 1). We have indicated before (5) that among all the compounds present in the smoke solution, only p-BSQ is singly responsible for protein oxidation. FIG. 2 shows that oxidation of BSA, as evidenced by carbonyl formation, is almost quantitatively correlated with the contents of p-BSQ present in the incubation medium. As would be expected, reduction of p-BSQ content in the smoke by the use of charcoal filter is accompanied by marked inhibition of BSA oxidation (Table 1). Use of charcoal filter also results in reduction of some tar and nicotine (Table 1). The most effective grain sizes of activated charcoal, expressed in British Standard (BS) mesh, are 44/52, 52/60, 60/72 and 72/85 used singly or in combination. Grain sizes larger than 44/52, namely 25/44 and 10/25 are not efficient even when used in comparatively large amounts. Use of large amounts of charcoal (0.4 g to 1.0 g) causes problem in suction of the smoke. Use of coconut shell activated charcoal did not have any added advantage over commercially available activated charcoal. The most effective charcoal filters, those markedly reduce p-BSQ content in the smoke without significantly affecting the suction and providing comfortable mouthful of smoke, as evidenced by a panel of middle aged smokers, are given in the Table 1. The charcoal filters comprise 0.2 and 0.3 g of BS 44/52, 0.2 and 0.3 g of BS 52/60, 0.15 and 0.2 g of BS 60/72, 0.1 and 0.15 g of BS 72/85, a mixture of 0.2 g of BS 44/52 and 0.1 g of BS 52/60, a mixture of 0.2 g of BS 44/52 and 0.1 g of BS 60/72, a mixture of 0.1 g of BS 44/52 and 0.1 g of BS 72/85, a mixture of 0.2 g of BS 44/52 and 0.1 g of BS 72/85, a mixture of 0.15 g of BS 44/52 and 0.1 g of BS 72/85, a mixture of 0.1 g of BS 52/60 and 0.1 g of BS 60/72, a mixture of 0.1 g of BS 52/60 and 0.1 g of 72/85, and a mixture of 0.1 g of BS 60/72 and 0.1 g of BS 72/85, a mixture of 0.1 g of BS 52/60 and 0.05 g of BS 72/85, and a mixture of 0.1 g of BS 60/72 and 0.05 g of BS 72/85.. With the said charcoal filters, reduction of p-BSQ was in the range of 55 to 85 percent, with a corresponding inhibition of BSA oxidation was in the range of 55 to 82 percent.

Effect of Fortification of Tobacco of the Charcoal Filter Cigarettes with Nicotine on the p-BSQ, Tar and Nicotine Delivery of the Smoke from an Indian Commercial Cigarette Table 1 shows that the charcoal filter cigarettes mentioned in this invention are very effective for markedly reducing the content of p-BSQ, the major hazardous oxidant present in the mainstream smoke. Table 1 further shows that the tar and nicotine delivery of these charcoal filter cigarettes are also considerably reduced. These charcoal filter cigarettes may therefore be considered as potentially safer mild cigarette. Apprehending that there might be some committed smokers who would not like mild cigarette with low nicotine delivery, the tobacco of some of the charcoal filter cigarettes has been fortified with 2 mg nicotine per cigarette and the results are given in Table 2. The results indicate that fortification of tobacco with 2 mg nicotine per cigarette lead to increase the nicotine delivery of the smoke considerably. The increase in nicotine delivery is accompanied by increase in tar content (Table 2). Fortification of tobacco with 3–4 mg nicotine produces about 30–50 percent more nicotine delivery (results not shown). However, fortification of tobacco with nicotine does not lead to any increase of p-BSQ content of the smoke, apparently because nicotine is not a precursor of p-BSQ and it does not contribute to either the level of p-BSQ in smoke or oxidation of BSA by the smoke solution (Table 2). The results would indicate that although fortification of tobacco with nicotine of the charcoal filter cigarettes results in increased nicotine delivery, but the said charcoal filter cigarettes remain potentially safer cigarettes.

Effects of Charcoal Filters on the Nitric Oxide Level in the Smoke Solution from an Indian Commercial Cigarette Nitric oxide (NO) is one of the most important free radicals in the gas phase of cigarette smoke. Some scientists think that NO may be implicated in the development of chronic obstructive pulmonary disease and emphysema in the smokers. Results presented in Table 3 indicates that activated charcoal filter is very effective in reducing the NO level in the mainstream smoke. Using a mixture 0.2 g of BS 44/52 and 0.1 g of BS 72/85, the percent inhibition in the NO is as high as 68.

Protective Effect of Charcoal Filters on the Cigarette Smoke Induced Oxidative Degradation of Guinea Pig Lung Microsomal Proteins in vitro FIG. 3 (lane 2) shows that cigarette smoke solution obtained from an Indian commercial cigarette causes extensive damage of guinea pig lung microsomal proteins as evidenced by SDS-PAGE. The figure further shows that the oxidative damage of microsomal proteins is markedly reduced when the said cigarette was equipped with activated charcoal filters, namely, BS 52/60, 0.3 g (lane 3); a mixture of BS 44/52, 0.2 g and BS 72/85, 0.1 g (lane 4); a mixture of BS 60/72, 0.1 g and BS 72/85, 1.0 g (lane 5).

Protective Effect of Charcoal Filter on the Cigarette Smoke Induced Oxidative Damage of Guinea Pig Lung Microsomal Proteins in vivo FIG. 4 (lane 2) shows that after exposure of the guinea pigs to cigarette smoke, lung microsomal proteins are discernibly damaged, as evidenced by SDS-PAGE. The oxidative damage is significantly protected when the animals are exposed to smoke from cigarettes equipped with activated charcoal filter containing a mixture of 0.1 g of BS 52/60 and 0.1 g of BS 60/72.

TABLE 1 p-Benzosemiquinone (p-BSQ), BSA oxidation, nicotine delivery and tar contents in the smoke solution from an Indian commercial cigarette with stipulated amounts of different grain sizes of activated charcoal

| | Activated charcoal | | P-BSQ content in | Percent inhibition | BSA oxidation[d] (nmoles of carbonyl | Percent inhibition | Nicotine | Tar |
|---|---|---|---|---|---|---|---|---|
| S1.No | Grain size (BS mesh)* | Weight (g) | smoke (μg) | in p-BSQ content | formed/ mg BSA) | in BSA oxidation | Delivery (μg) | content (mg) |
| 1 | NIL | NIL | 180 | — | 10.65 | — | 935 | 20 |
| 2 | 44/52[b] | 0.20 | 81 | 55 | 4.79 | 55 | 525 | 18 |
| 3 | 44/52 | 0.30 | 50 | 72 | 3.20 | 70 | 425 | 15 |
| 4 | 52/60 | 0.20 | 63 | 65 | 3.62 | 66 | 420 | 14 |
| 5 | 52/60 | 0.30 | 27 | 85 | 1.90 | 82 | 350 | 10 |
| 6 | 60/72 | 0.15 | 72 | 60 | 4.26 | 60 | 425 | 15 |
| 7 | 60/72 | 0.20 | 45 | 75 | 2.87 | 73 | 370 | 12 |
| 8 | 72/85 | 0.10 | 70 | 61 | 4.26 | 60 | 500 | 18 |
| 9 | 72/85 | 0.15 | 50 | 72 | 3.20 | 70 | 450 | 15 |
| 10 | 44/52[c] +52/60 | 0.20 +0.10 | 49 | 73 | 3.20 | 70 | 400 | 14 |
| 11 | 44/52 +60/72 | 0.20 +0.10 | 43 | 76 | 2.66 | 75 | 400 | 12 |
| 12 | 44/52 +72/85 | 0.10 +0.10 | 50 | 72 | 3.20 | 70 | 400 | 13 |
| 13 | 44/52 +72/85 | 0.20 +0.10 | 29 | 84 | 1.92 | 82 | 350 | 10 |
| 14 | 44/52 +72/85 | 0.15 +0.10 | 36 | 80 | 2.24 | 79 | 365 | 10 |
| 15 | 52/60 +60/72 | 0.10 +0.10 | 58 | 68 | 3.73 | 65 | 400 | 13 |

TABLE 1-continued p-Benzosemiquinone (p-BSQ), BSA oxidation, nicotine delivery and tar contents in the smoke solution from an Indian commercial cigarette with stipulated amounts of different grain sizes of activated charcoal

| S1.No | Activated charcoal: Grain size (BS mesh)* | Activated charcoal: Weight (g) | P-BSQ content in smoke (μg) | Percent inhibition in p-BSQ content | BSA oxidation[d] (nmoles of carbonyl formed/ mg BSA) | Percent inhibition in BSA oxidation | Nicotine Delivery (μg) | Tar content (mg) |
|---|---|---|---|---|---|---|---|---|
| 16 | 52/60 +72/85 | 0.10 +0.10 | 50 | 72 | 3.20 | 70 | 360 | 12 |
| 17 | 60/72 +72/85 | 0.10 +0.10 | 40 | 78 | 2.66 | 75 | 350 | 11 |
| 18 | 52/60 +72/85 | 0.10 +0.05 | 64 | 65 | 3.60 | 66 | 430 | 15 |
| 19 | 60/72 +72/85 | 0.10 +0.05 | 50 | 72 | 3.20 | 70 | 440 | 15 |

[a]British standard
[b]BS 44/52 means particles passing through mesh 44, but retained on mesh 52. All other grain sizes mentioned in the Table are explained in the same way.
[c]Indicates mixture of the two grain sizes
[d]Amount of carbonyl formed by 50 μl of smoke solution. Details of the incubation system and measurement of carbonyl are given under Methodology Section.

TABLE 2

Effect of fortification of tobacco of the charcoal filter cigarettes with nicotine on the p-BSQ, tar and nicotine delivery in the smoke solution from an Indian commercial cigarette

| S1.No. | Charcoal filter | Fortification with nicotine (mg) + | p-BSQ content (μg)* | Nicotine delivery* (μg) + | Tar (mg) | BSA oxidation nmoles of carbonyl formed per mg BSA* |
|---|---|---|---|---|---|---|
| 1 | None | None | 180 | 935 | 20 | 10.60 |
| 2 | BS 52/60, 0.3 g | None | 27 | 350 | 10 | 1.90 |
| 3 | BS 52/60, 0.3 g | 2 | 27 | 610 | 14 | 1.95 |
| 4 | BS 44/52, 0.2 g + BS 52/60, 0.1 g | None | 49 | 400 | 14 | 3.20 |
| 5 | BS 44/52, 0.2 g + BS 52/60, 0.1 g | 2 | 49 | 670 | 17 | 3.25 |
| 6 | BS 60/72, 0.2 g | None | 45 | 370 | 12 | 2.85 |
| 7 | BS 60/72, 0.2 g | 2 | 45 | 650 | 16 | 2.80 |
| 8 | BS 44/52, 0.2 g + BS 60/72, 0.1 g | None | 43 | 400 | 12 | 2.66 |
| 9 | BS 44/52, 0.2 g + BS 60/72, 0.1 g | 2 | 43 | 650 | 16 | 2.65 |
| 10 | BS 44/52, 0.1 g + BS 72/85, 0.1 g | None | 50 | 400 | 13 | 3.20 |
| 11 | BS 44/52, 0.1 g + BS 72/85, 0.1 g | 2 | 50 | 700 | 17 | 3.25 |
| 12 | BS 44/52, 0.2 g + BS 72/85, 0.1 g | None | 29 | 350 | 10 | 1.90 |
| 13 | BS 44/52, 0.2 g + BS 72/85, 0.1 g | 2 | 29 | 575 | 14 | 1.95 |
| 14 | BS 44/52, 0.15 g + BS 72/85, 0.1 g | None | 36 | 365 | 10 | 2.24 |
| 15 | BS 44/52, 0.15 g + BS 72/85, 0.1 g | 2 | 36 | 600 | 13 | 2.24 |
| 16 | BS 52/60, 0.1 g + BS 72/85, 0.1 g | None | 50 | 360 | 12 | 3.20 |
| 17 | BS 52/60, 0.1 g + BS 72/85, 0.1 g | 2 | 50 | 600 | 15 | 3.25 |
| 18 | BS 60/72, 0.1 g + BS 72/85, 0.1 g | None | 40 | 350 | 11 | 2.65 |
| 19 | BS 60/72, 0.1 g + BS 72/85, 0.1 g | 2 | 40 | 605 | 14 | 2.66 |

*Values are means of four determinations; SD < 10%
+ Fortification of the tobacco with 3 mg nicotine instead of 2 mg nicotine results in about 30 percent more delivery of nicotine in the smoke (results not shown)

TABLE 3

Effects of charcoal filters on the nitric oxide level in the smoke solution from an Indian commercial cigarette

| S1.No | Charcoal filter | Nitric oxide (μg) | % Inhibition in the NO level |
|---|---|---|---|
| 1 | None | 62 | — |
| 2 | BS 52/60, 0.3 g | 28 | 55 |
| 3 | BS 60/72, 0.2 g | 35 | 44 |
| 4 | BS 44/52, 0.15 g + BS 72/85, 0.1 g | 21 | 66 |
| 5 | BS 60/72, 0.1 g + BS 72/85, 0.1 g | 34 | 45 |
| 6 | BS 44/52, 0.2 g + BS 60/72, 0.1 g | 30 | 52 |
| 7 | BS 44/52, 0.2 g + BS 72/85, 0.1 g | 20 | 68 |

TABLE 4

Inactivation of the major harmful cs-oxidant and nicotine delivery in cigarette smoke using activated charcoal filter

| Size and weight of active charcoal used | Fortification with nicotine (mg) | Length of the cigarette tobacco (mm) | Length of the◆ conventional filter (mm) | Length of the* charcoal filter (mm) | % inhibition of BSA oxidation | % of nicotine delivered in the smoke |
|---|---|---|---|---|---|---|
| None | — | 63 mm | 11 | None | — | 100** |
| BS 44,0.6 gm# | None | 63 mm | 8 + 3 | 26 | 68 | 46 |
| BS 44,0.6 gm# | 3 | 63 mm | 8 + 3 | 26 | 68 | 74 |
| BS 44,0.6 gm# | 4 | 63 mm | 8 + 3 | 26 | 68 | 98 |
| BS 44 + BS 52# 0.6 gm 0.2 gm | None | 63 mm | 7 + 3 + 3 | 26 + 9 ● | 89 | 30 |
| BS 44 + BS 52# 0.6 gm 0.2 gm | 3 | 63 mm | 7 + 3 + 3 | 26 + 9 | 89 | 65 |
| BS 44 + BS 52# 0.6 gm 0.2 gm | 4 | 63 mm | 7 + 3 + 3 | 26 + 9 | 89 | 90 |

*Internal diameter of the charcoal filter was 8 mm.
**The percentage was calculated taking nicotine delivered (940 μg ± 40 S.D; n = 6) from cigarette with conventional filter as 100
#BS 44 indicates BS 25 (−) to BS 44 (+), particle size of 350–700 μm
≠ BS 52 indicates BS 44 (−) to BS 52 (+), particle size of 250–350 μm
● 26 mm BS 44 + 9 mm BS 52
◆The lengths of the conventional filters have been depicted in FIGS. 36 and 37.

REFERENCES 1 http://www.tobaccoreporter.com/backissues/Dec2000/Dec2000_feature2.asp
2 Denissenko, M. F., Pao, A., Tang, M. S. and Pfeifer, G. P. Science 274,430–432 (1996)
3 Hecht, S. S., Spratt, T. E and Trushin, N. Carcinogenesis 9, 161–165 (1988)
4 Panda, K., Chattopadhyay, R., Ghosh, M. K., Chattopadhyay, D. J. and Chatterjee, I. B., Free Radic. Biol. Med. 27, 1064–1079 (1999)
5 Chatterjee, I. B., Indian Patent Application No 701/DEL/2001
6 Nagata,., Kodama, M. and Ioki, Y. in Polycyclic Hydrocarbons and Cancer, Gelboin, H. V. and Ts'O, P.O.P. Eds (Academic Press, New York), 1, 247 (1978)
7 Pryor, W. A., Environ. Health Perspect 105, Suppl. 4, 1, (1997)
8 Church, D. F. and Pryor, W. A. Environ. Health Perspect. 64, 111–126 (1985)
9 http://www.law.Indiana.edu/ilj/v73/no3/givelber.html
10 Stavridis et. al. U.S. Pat. No. 5,909,736, Jun. 8,(1999)
11 Osaga et. al. U.S. Pat. No. 4,038,992, Aug. 2,(1977)
12 Innacelli, U.S. Pat. No. 4,373,539, Feb. 15, 1983
13 WO Patent No. 9600019
14 U.S. Pat. No. 5,360,023
15 U.S. Pat. No. 3,658,069
16 http://www.starscientific.com/066745321909/advance-filter.html
17 http://www.ryomagazine.com/october/filters.htm
18 www.baumgartnerinc.com/whatsnew.htm
19 Panda, K., Chattopadhyay, R., Chattopadhyay, D. J. and Chatterjee, I. B., Free Radic. Biol. Med. 29, 115–124 (2000)

The invention claimed is:

1. A filter for a tobacco smoke inhaling/generating/producing device, the filter having three sections placed longitudinally one after another, comprising:

a first section comprising cellulose acetate fiber acting as a mouth piece;

a second section comprising requisite amounts of specific mesh sizes of activated charcoal selected from the group consisting of charcoal particles having mesh sizes of BS 44/52, BS 52/60, BS 60/72, BS 72/85, and any combinations thereof for effectively reducing p-benzosemiquinone, a highly reactive major harmful oxidant from the mainstream of said tobacco smoke; and a third section comprising cellulose acetate fiber located closer to a tobacco portion, also acting as a barrier between the activated charcoal and tobacco portion, wherein the activated charcoal is selected from the group consisting of 0.2 g of mesh size BS 44/52 and 0.1 p of mesh size BS 52/60, 0.2 g of mesh size BS 44/52 and 0.1 g of mesh size BS 60/72, 0.1 g of mesh size BS 44/52 and 0.1 g of mesh size BS 72/85, 0.2 g of mesh size BS 44/52 and 0.1 g of mesh size BS 72/85, 0.15 g of mesh size BS 44/52 and 0.1 g of mesh size BS 72/85, 0.1 g of mesh size BS 52/60 and 0.1 g of mesh size BS 60/72, 0.1 g of mesh size BS 52/60 and 0.1 g of mesh size BS 72/85, 0.1 g of mesh size BS 60/72 and 0.1 g of mesh size BS 72/85, 0.1 g of mesh size BS 52/60 and 0.05 g of mesh size BS 72/85, and 0.1 g of mesh size BS 60/72 and 0.05 g of mesh size BS 72/85, and any combinations thereof.

2. The filter as claimed in claim 1, wherein the length of the first section is in the range of 10 to 14 mm.

3. The filter as claimed in claim 1, wherein the length of the second section is dependent on the mesh size and/or amount of charcoal used.

4. The filter as claimed in claim 1, wherein the length of the second section is in the range of 4.5 mm to 35 mm.

5. The filter as claimed in claim 1, wherein the length of the third section is in the range of 2 to 3 mm.

6. The filter as claimed in claim 1, wherein all the three sections are linearly joined together in succession using a thin wall tube made of lightweight material selected from the group consisting of thin wall plastic tube, paper, plastic wrapped paper and aluminum foil.

7. The filter as claimed in claim 1, wherein requisite amounts of specific mesh sizes of the activated charcoal ranging between BS 44/52 and BS 72/85 mesh are placed in a void space between the sections of cellulose acetate filters namely the mouthpiece and the barrier.

8. The filter as claimed in claim 1, wherein the amount of charcoal used is in the range between 0.1 g and 0.3 g.

9. The filter as claimed in claim 1, wherein the activated charcoal particle comprises 0.3 g of the mesh size BS 44/52.

10. The filter as claimed in claim 1, wherein the activated charcoal particle comprises 0.2 g of the mesh size BS 52/60.

11. The filter as claimed in claim 1, wherein the activated charcoal particle comprises 0.3 g of the mesh size BS 52/60.

12. The filter as claimed in claim 1, wherein the activated charcoal particle comprises 0.15 g of the mesh size BS 60/72.

13. The filter as claimed in claim 1, wherein the activated charcoal particle comprises 0.2 g of the mesh size BS 60/72.

14. The filter as claimed in claim 1, wherein the activated charcoal particle comprises 0.15 g of the mesh size BS 72/85.

15. The filter as claimed in claim 1, wherein said filter inhibits p-benzosemiquinone (p-BSQ) of said smoke up to 85 percent.

16. The filter as claimed in claim 1, wherein said filter inhibits protein oxidation, as evidenced by carbonyl formation in BSA by the smoke up to 89 percent.

17. The filter as claimed in claim 1, wherein said filter reduces nitric oxide (NO) of the smoke up to 68 percent.

18. The filter as claimed in claim 1, wherein nicotine delivery in the smoke is reduced.

19. The filter as claimed in claim 1, wherein use of a nicotine fortified tobacco portion results in increased delivery of nicotine without increasing the level of p-BSQ.

20. The filter as claimed in claim 19, wherein said tobacco fortified with 2 to 4 mg of nicotine increases the nicotine delivery without increasing the level of p-BSQ.

21. The filter as claimed in claim 19, wherein tobacco fortified with 2 to 4 mg of nicotine increases the nicotine delivery in the main stream smoke from 350–400 μg to 575–700 μg without increasing the level of p-BSQ.

22. The filter as claimed in claim 21, wherein nicotine fortified tobacco with 2 to 4 mg of nicotine, delivers nicotine up to 90% without increasing the level of p-BSQ.

23. The filter as claimed in claim 1, wherein the smoke is incapable of producing significant oxidative damage to guinea pig lung microsomal proteins in vitro.

24. The filter as claimed in claim 1, wherein said filter comprising charcoal particles having mesh size ranging between BS 44/52 to BS 72/85 mesh is proportionate to the length of the device.

25. The filter as claimed in claim 1, wherein said charcoal particles having sizes ranging between BS 44/52 mesh to BS 72/85 mesh, are proportionate to effectively reducing the level of p-benzosemiquinone (p-BSQ) from the smoke while providing a comfortable mouthful of smoke and nicotine delivery.

26. The filter as claimed in claim 1, wherein said filter is used in smoking devices selected from group consisting of cigarettes, cigarette holders, pipes and any other smoking devices.

27. The filter as claimed in claim 1, wherein said activated charcoal effectively reduces p-BSQ of the tobacco smoke, and wherein said filter is incorporated into a filter of a tobacco smoking device such as a cigarette, cigar, pipe or in a separate filter through which tobacco smoke passes before the process of inhaling.

28. The filter as claimed in claim 1, wherein the smoke containing very low level of p-BSQ is incapable of producing significant oxidative damage to the lung microsomal proteins of guinea pigs when said guinea pigs are exposed to smoke emitted from said charcoal-filtered tobacco smoke devices in contrast to marked damage of the lung tissue when the guinea pigs are exposed to smoke from tobacco smoke devices without having the charcoal filter.

29. A tobacco smoke filter comprising at least three sections placed longitudinally one after another, comprising:

a first section comprising cellulose acetate fiber;

a second section comprising an activated charcoal formed by charcoal particles having a mesh size selected from the group consisting of: BS 44/52, BS 52/60, BS 60/72, BS 72/85, and any combinations thereof for effectively reducing p-benzosemiquinone; and a third section comprising cellulose acetate fiber which provides a barrier between said activated charcoal and said tobacco, wherein the activated charcoal is selected from the group consisting of 0.2 g of mesh size BS 44/52 and 0.1 g of mesh size BS 52/60, 0.2 g of mesh size BS 44/52 and 0.1 g of mesh size BS 60/72, 0.1 g of mesh size BS 44/52 and 0.1 g of mesh size BS 72/85, 0.2 g of mesh size BS 44/52 and 0.1 g of mesh size BS 72/85, 0.15 g of mesh size BS 44/52 and 0.1 g of mesh size BS 72/85, 0.1 g of mesh size BS 52/60 and 0.1 g of mesh size BS 60/72, 0.1 g of mesh size BS 52/60 and 0.1 g of mesh size BS 72/85, 0.1 g of mesh size BS 60/72 and 0.1 g of mesh size BS 72/85, 0.1 g of mesh size BS 52/60 and 0.05 g of mesh size BS 72/85, 0.1 g of mesh size BS 60/72 and 0.05 g of mesh size BS 72/85, and any combinations thereof.

* * * * *